US009187272B2

(12) United States Patent
Kainuma

(10) Patent No.: US 9,187,272 B2
(45) Date of Patent: Nov. 17, 2015

(54) SHEET FEEDING DEVICE AND IMAGE FORMING APPARATUS INCLUDING THE SAME

(71) Applicant: KYOCERA Document Solutions Inc., Osaka (JP)

(72) Inventor: Takashi Kainuma, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/230,562

(22) Filed: Mar. 31, 2014

(65) Prior Publication Data

US 2014/0300044 A1 Oct. 9, 2014

(30) Foreign Application Priority Data

Apr. 5, 2013 (JP) ..... 2013-079157

(51) Int. Cl.

| | |
|---|---|
| ***B65H 31/34*** | (2006.01) |
| ***B65H 31/20*** | (2006.01) |
| ***B65H 1/04*** | (2006.01) |
| ***B65H 29/52*** | (2006.01) |
| ***B65H 31/02*** | (2006.01) |

(52) U.S. Cl.

CPC ..... *B65H 1/04* (2013.01); *B65H 29/52* (2013.01); *B65H 31/02* (2013.01); *B65H 31/20* (2013.01); *B65H 31/34* (2013.01); *B65H 2301/4212* (2013.01); *B65H 2402/5151* (2013.01); *B65H 2403/411* (2013.01); *B65H 2404/61* (2013.01); *B65H 2404/742* (2013.01); *B65H 2405/115* (2013.01); *B65H 2405/3321* (2013.01); *B65H 2511/12* (2013.01); *B65H 2511/20* (2013.01); *B65H 2801/06* (2013.01); *B65H 2801/39* (2013.01)

(58) Field of Classification Search

CPC ..... B65H 1/04; B65H 31/00; B65H 31/34; B65H 31/20; B65H 2405/3321; B65H 2511/12; B65H 29/52; B65H 29/70; G03G 15/00

USPC ..... 271/171, 3.14, 207, 223; 399/367, 377, 399/405, 393

See application file for complete search history.

(56) References Cited

U.S. PATENT DOCUMENTS

| | | | | |
|---|---|---|---|---|
| 6,926,267 | B2 * | 8/2005 | Kobayashi | 271/3.14 |
| 8,041,283 | B2 * | 10/2011 | Murai | 399/367 |
| 2013/0320613 | A1 * | 12/2013 | Sakamoto | 271/145 |

FOREIGN PATENT DOCUMENTS

| | | | |
|---|---|---|---|
| JP | 05338926 | A * | 12/1993 |
| JP | 2003306263 | A * | 10/2003 |
| JP | 2006-027804 | A | 2/2006 |
| JP | 2007-015776 | A | 1/2007 |

* cited by examiner

*Primary Examiner* — Luis A Gonzalez
(74) *Attorney, Agent, or Firm* — Studebaker & Brackett PC

(57) ABSTRACT

A sheet feeding device includes a feeding tray, a conveying device, an ejecting tray, a feeding guide and a conveying rib. On the feeding tray, a sheet is placed. The conveying device feeds the sheet on the feeding tray to an image reading device. The ejecting tray receives the sheet after image reading. The feeding guide is configured to be movable in a direction intersecting a feeding direction of the sheet and to regulate a position in a width direction of the sheet on the feeding tray. The conveying rib is configured to be movable in interlocking with movement of the feeding guide and to lead the sheet to be ejected onto the ejecting tray.

6 Claims, 9 Drawing Sheets

SHEET FEEDING DEVICE AND IMAGE FORMING APPARATUS INCLUDING THE SAME

INCORPORATION BY REFERENCE

This application is based on and claims the benefit of priority from Japanese Patent application No. 2013-079157 filed on Apr. 5, 2013, the entire contents of which are incorporated herein by reference.

BACKGROUND

The present disclosure relates to a sheet feeding device preferably applied in a copying machine, a printer or the like and to an image forming apparatus including this.

There is a sheet (document) feeding device feeding a document placed on a feeding tray to an image reading part by a conveying device and ejecting the document after the completion of reading in the image reading part to an ejected sheet tray positioned below the feeding tray.

For example, there is an automatic sheet feeding device including a document guide slidably operated in accordance with width of the document placed on a document platen to regulate ends in a width direction of the document and three sensors detecting a slide position of the document guide. In this automatic sheet feeding device, each sensor detects size of the document on the document platen on the basis of the position of the document guide. The document after conveying process and reading process from the document platen is ejected below the document platen.

Moreover, for example, there is an automatic sheet feeding device including a feeding sheet tray and an ejected sheet tray. The feeding sheet tray has a pair of left and right feeding sheet side guide plates opposed to each other slidably in a document width direction. The ejected sheet tray has a pair of left and right ejected sheet side guide plates respectively integrated with the feeding sheet side guide plates and configured to be slidable in interlocking with the feeding sheet side guide plates. The ejected sheet tray is also arranged below the feeding sheet tray. In this automatic sheet feeding device, a conveying part leads the document on the feeding sheet tray to an image reading part. The document after the reading process is ejected to the ejected sheet tray.

Incidentally, the above-mentioned former and latter automatic sheet feeding devices convey a plurality of the documents in order and carry out the reading process. The plurality of the ejected documents are placed on the ejected sheet tray in a stacked state. Such automatic sheet feeding devices generally feed the ejected document obliquely upward to the ejected sheet tray in order to prevent paper jam, incorrect collation and others from causing by a collision of the following ejected document with the document already ejected on the ejected sheet tray.

However, because the document ejected obliquely upward collides a lower face of the feeding sheet tray and is not placed at an appropriate position on the ejected sheet tray, there is a possibility that such a document causes the jam, incorrect collation and others in the vicinity of a sheet ejected port. In general, in the above-mentioned automatic sheet feeding devices, a plurality of conveying ribs changing an ejecting direction to a lower direction are fixedly arranged in the vicinity of an ejecting port of the document (e.g. in the lower face of the feeding sheet tray and others). The document is placed at the appropriate position on the ejected sheet tray by the plurality of conveying ribs. Because contact area of the ejected document surface with the conveying rib is reduced, the document is smoothly ejected.

However, it is necessary to position the conveying ribs at appropriate positions corresponding with the size of the document. In the above-mentioned automatic sheet feeding devices, it is necessary to arrange the plurality of the conveying ribs in the width direction of the document in parallel in order to correspond with the documents of different sizes. Therefore, the above-mentioned automatic sheet feeding devices have a problem that, as the size of the document is increased, the number of the conveying ribs to be installed is increased. If one sized document is fitted to a side face of the conveying ribs corresponding with another sized document, the ejection of the one document may be interfered (an occurrence of ejection interference).

SUMMARY

In accordance with one aspect of the present disclosure, a sheet feeding device includes a feeding tray, a conveying device, an ejecting tray, a feeding guide and a conveying rib. On the feeding tray, a sheet is placed. The conveying device feeds the sheet on the feeding tray to an image reading device. The ejecting tray receives the sheet after image reading. The feeding guide is configured to be movable in a direction intersecting a feeding direction of the sheet and to regulate a position in a width direction of the sheet on the feeding tray. The conveying rib is configured to be movable in interlocking with movement of the feeding guide and to lead the sheet to be ejected onto the ejecting tray.

In accordance with another aspect of the present disclosure, an image forming apparatus includes a sheet feeding device. The sheet feeding device includes a feeding tray, a conveying device, an ejecting tray, a feeding guide and a conveying rib. On the feeding tray, a sheet is placed. The conveying device feeds the sheet on the feeding tray to an image reading device. The ejecting tray receives the sheet after image reading. The feeding guide is configured to be movable in a direction intersecting a feeding direction of the sheet and to regulate a position in a width direction of the sheet on the feeding tray. The conveying rib is configured to be movable in interlocking with movement of the feeding guide and to lead the sheet to be ejected onto the ejecting tray.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

In the following, an image forming apparatus including a document feeding device as a sheet feeding device according to an embodiment of the present disclosure will be described with reference to the appended drawings. It is noted that in the following description, respective directions are defined by arrows shown in the figures for the sake of convenience.

Figure 1:
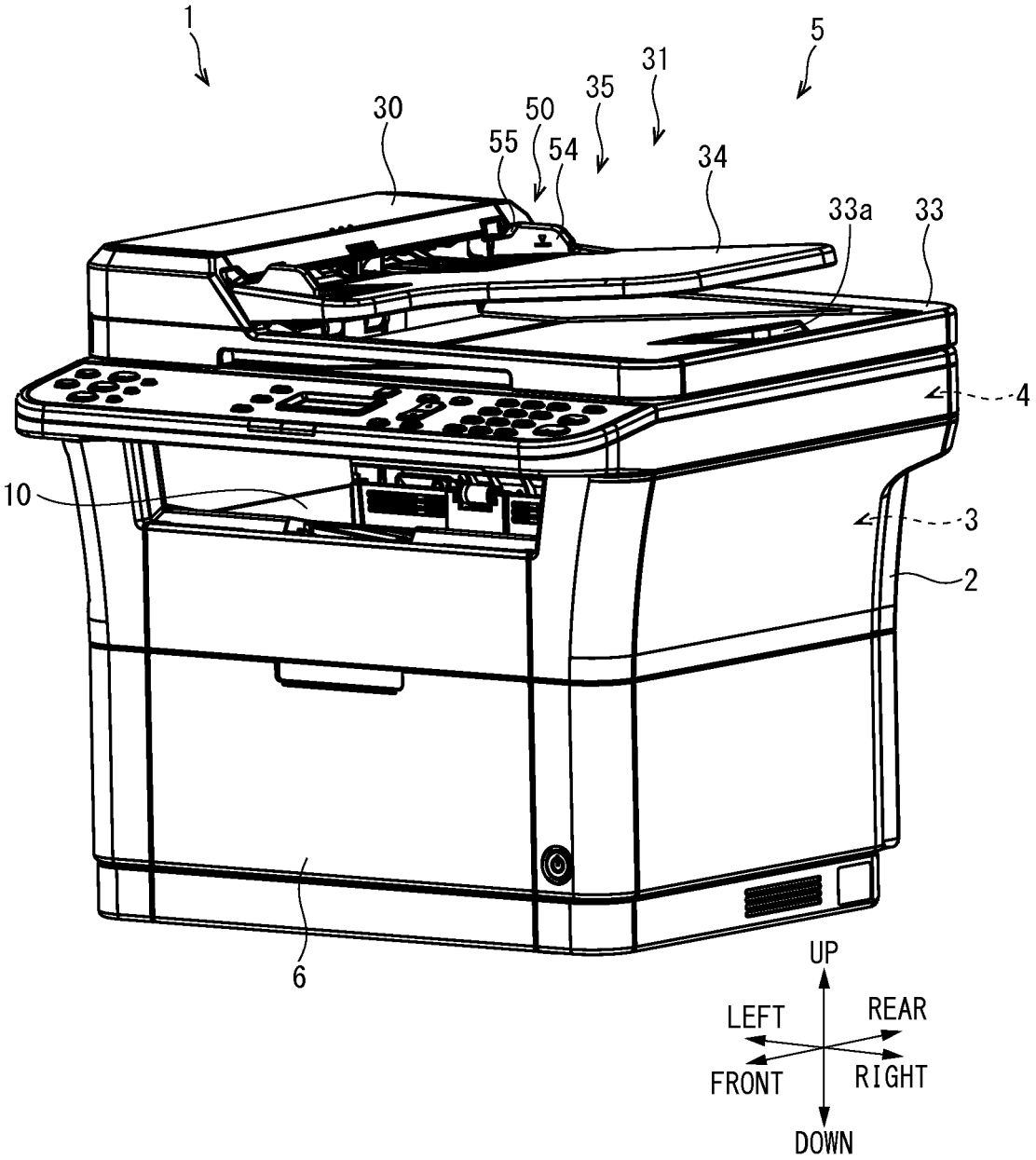
FIG. 1 is an exterior perspective view showing an image forming apparatus according to an embodiment of the present disclosure.
Figure 2:
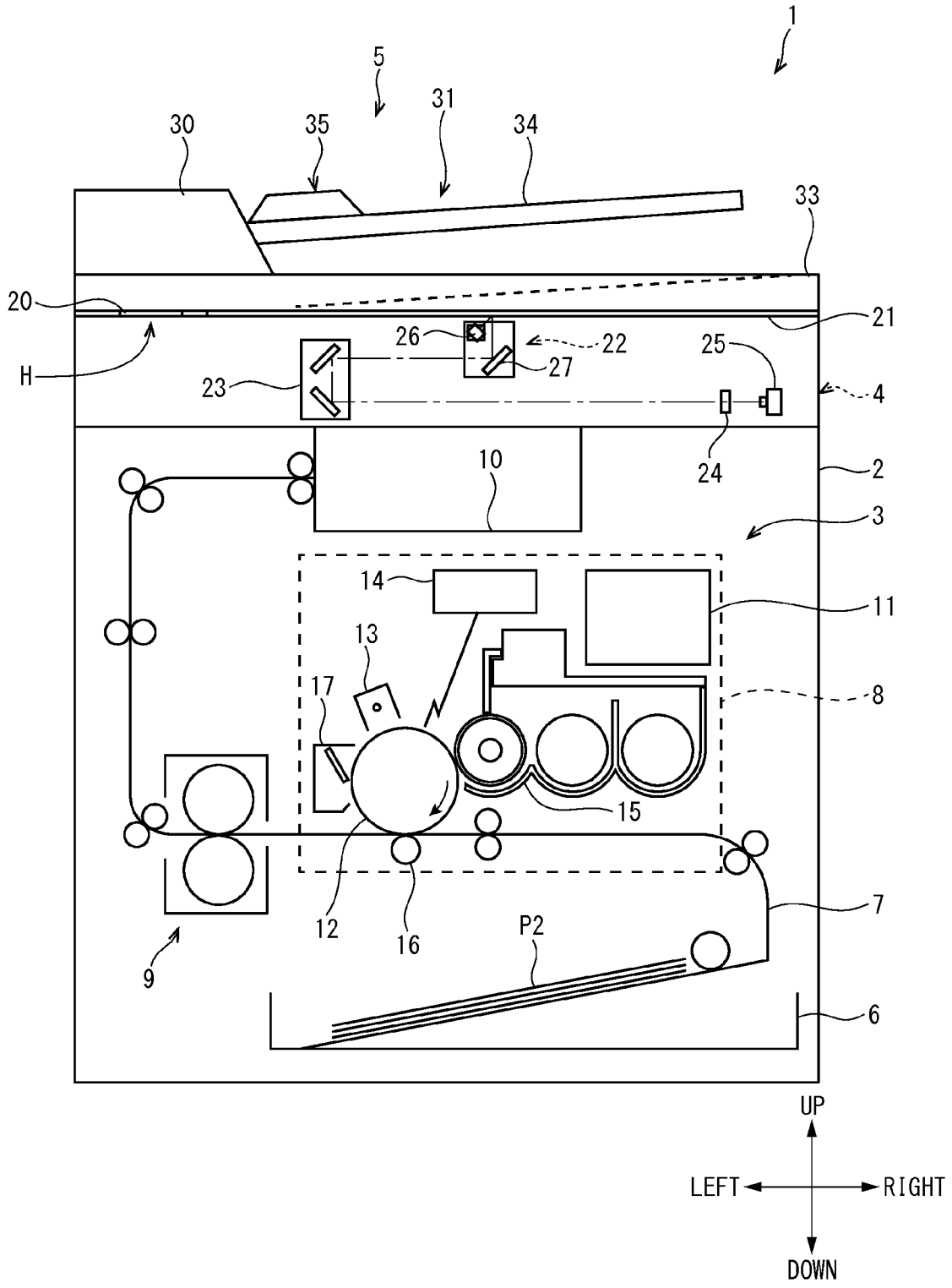
FIG. 2 is a sectional view schematically showing an internal structure of the image forming apparatus according to the embodiment of the present disclosure.

With reference to FIGS. 1 and 2, the image forming apparatus 1 will be descried. FIG. 1 is an exterior perspective view showing an image forming apparatus 1. FIG. 2 is a sectional view schematically showing an internal structure of the image forming apparatus 1.

The image forming apparatus 1 is configured that, inside a box-formed apparatus main body 2, a printer part 3, a scanner part 4 as an image reading device and others are installed. On an upper part of the apparatus main body 2, a document feeding device 5 is arranged to automatically feed a document P1 one by one to an image reading position H of the scanner part 4.

The printer part 3 carries out, for example, monochrome image forming process on the basis of image data transmitted from a personal computer (not shown) or the scanner part 4. The printer part 3 includes a paper sheet storing part 6 storing a paper sheet P2, an image forming part 8 transferring a toner image on the paper sheet P2 fed from the paper sheet storing part 6 to a conveying path 7, a fixing part 9 fixing the transferred toner image on the paper sheet P2 and a paper sheet ejecting part 10 as an ejection destination of the fixed paper sheet P2. The document P1 and paper sheet P2 as a sheet are not restricted by paper made one, but may be made by other recording medium, such as a resin film or an overhead projector (OHP) sheet.

The image forming part 8 is configured to include a toner container 11, a photosensitive drum 12, a charger 13, an exposure device 14, a development device 15, a transferring roller 16 and a cleaning device 17. The toner container 11 stores a replenishment toner (a developer (black)). The photosensitive drum 12 carries the toner image. The charger 13 charges a surface of the photosensitive drum 12 in a given voltage. The exposure device 14 irradiates the surface of the photosensitive drum 12 with a luminous flux to form a given electrostatic latent image. The development device 15 develops the electrostatic latent image to the toner image by the toner. The transferring roller 16 transfers the toner image on the photosensitive drum 12 to the paper sheet P2. The cleaning device 17 eliminates the toner remained on the surface of the photosensitive drum 12 after the transferring.

The scanner part 4 is configured to include a contact glass 20, a platen glass 21, an optical scanning unit 22, a reflecting unit 23 and a charge coupled device (CCD) 25. The contact glass 20 and platen glass 21 are fixed on the upper part of the apparatus main body 2. The optical scanning unit 22 is configured to enable reading of the document P1 on the glass 20 or 21. The reflecting unit 23 reflects light from the optical scanning unit 22. In the CCD 25, the light reflected by the reflecting unit 23 is inputted via a collecting lens 24. The collecting lens 24 and CCD 25 are arranged in fixed states.

The optical scanning unit 22 has a light source 26 irradiating the document P1 with the light and a reflecting part 27 directing the light reflected by the document P1 to the reflecting unit 23. The light irradiated by the light source 26 is reflected by the document P1 and inputted in the CCD 25. Thus, an image on the document P1 is converted to an electrical signal.

The optical scanning unit 22 is configured to enable, in a state fixed at an image reading position H, the reading of the document P1 (i.e. its image) passing through on the contact glass 20 by the document feeding device 5. The optical scanning unit 22 also can scan from the image reading position H to the right-hand side of FIG. 2 to read the document P1 (i.e. its image) placed on the platen glass 21. In such a case, the reflecting unit 23 is moved in the same direction as the optical scanning unit 22 so as to make an optical path length from the document P1 to the collecting lens 24 always constant. At this time, a moving amount of the reflecting unit 23 is a half of a moving amount of the optical scanning unit 22.

The image of the document P1 on the glass 20 or 21 is read by the optical scanning unit 22 and photoelectrically converted by the CCD 25 (in the scanner part 4). Photoelectrically converted image data is outputted from the scanner part 4 to the printer part 3. The printer part 3 carries out the image forming process.

The image forming process by the image forming apparatus 1 will be described in brief. When the image data is inputted from the scanner part 4 or the like, the exposure device 14 carries out exposure corresponding to the image data on the surface of the photosensitive drum electrically charged by the charger 13 to form the electrostatic latent image. This electrostatic latent image is developed to the toner image by the development device 15. The toner image is transferred, by transfer bias being applied to the transfer roller 16, on the paper sheet P2 conveyed in the conveying path 7 from the paper sheet storing part 6. The toner image is fixed on the paper sheet P2 by the fixing device 9. The paper sheet P2 with the fixed toner image is conveyed and ejected to the paper sheet ejecting part 10. The toner remained on the surface of the photosensitive drum 12 after the transferring is cleaned by the cleaning device 17.

Figure 3:
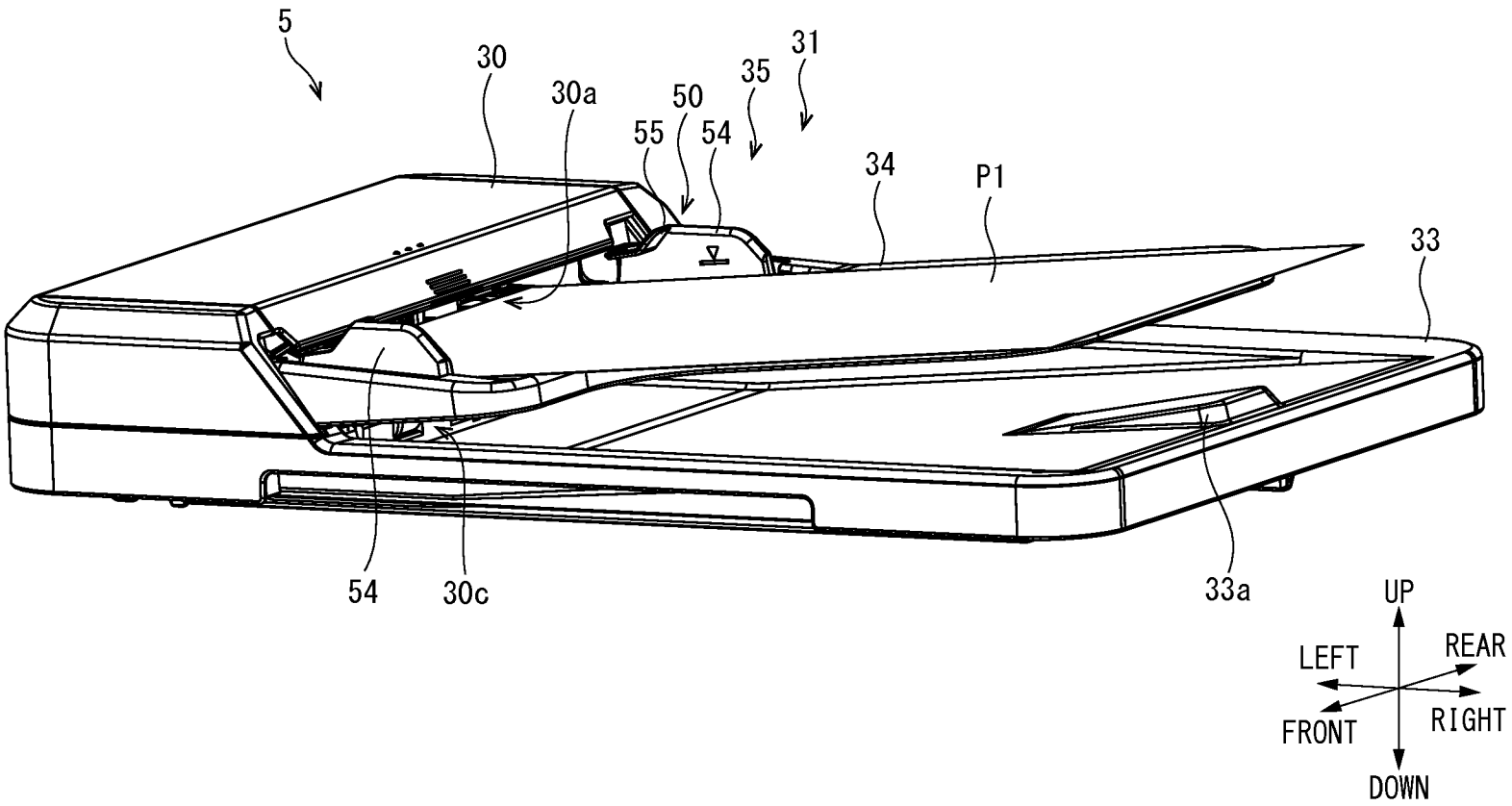
FIG. 3 is a perspective view showing a sheet feeding device according to the embodiment of the present disclosure.
Figure 4:
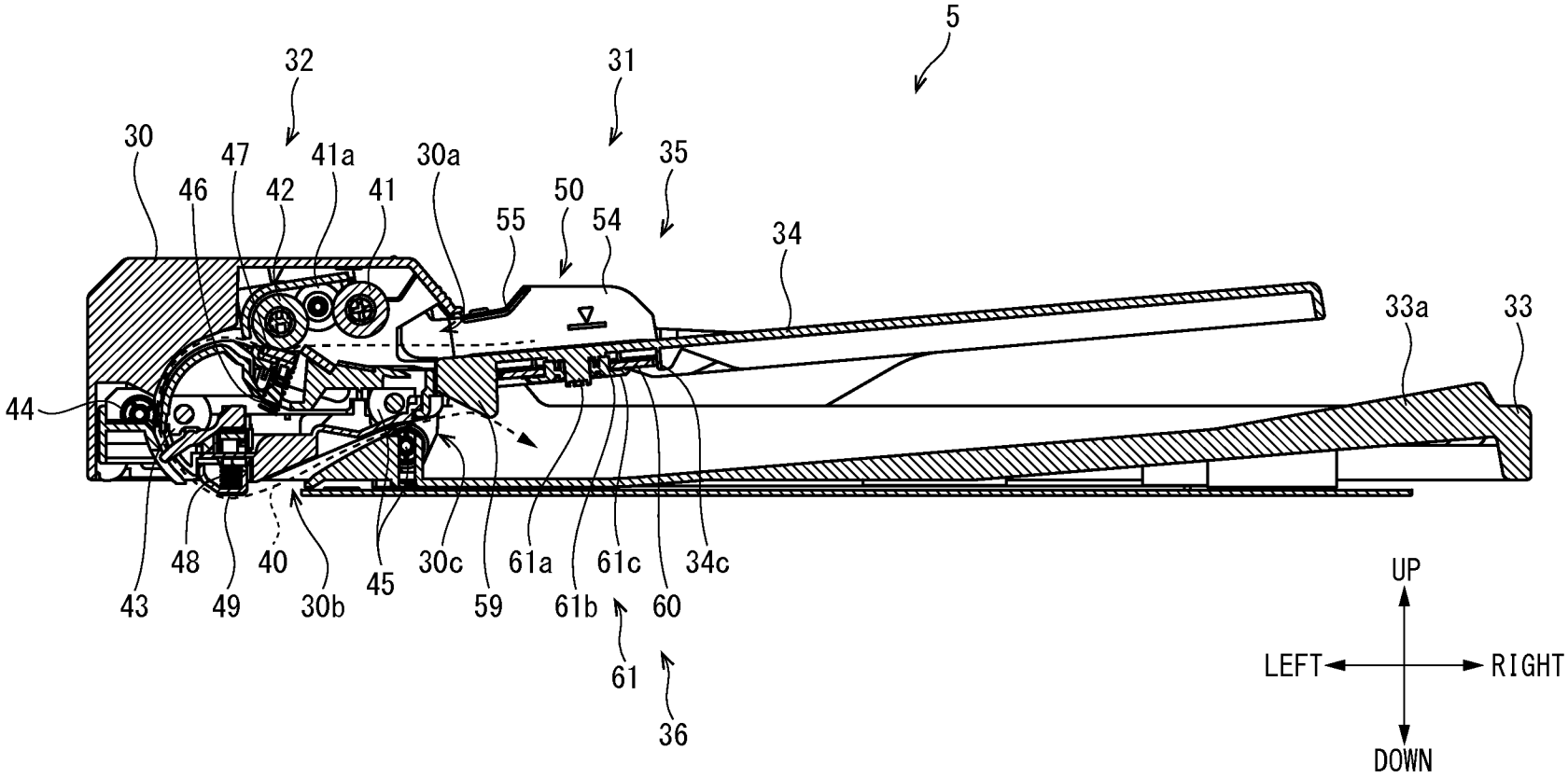
FIG. 4 is a side sectional view showing the sheet feeding device according to the embodiment of the present disclosure.
Figure 5:
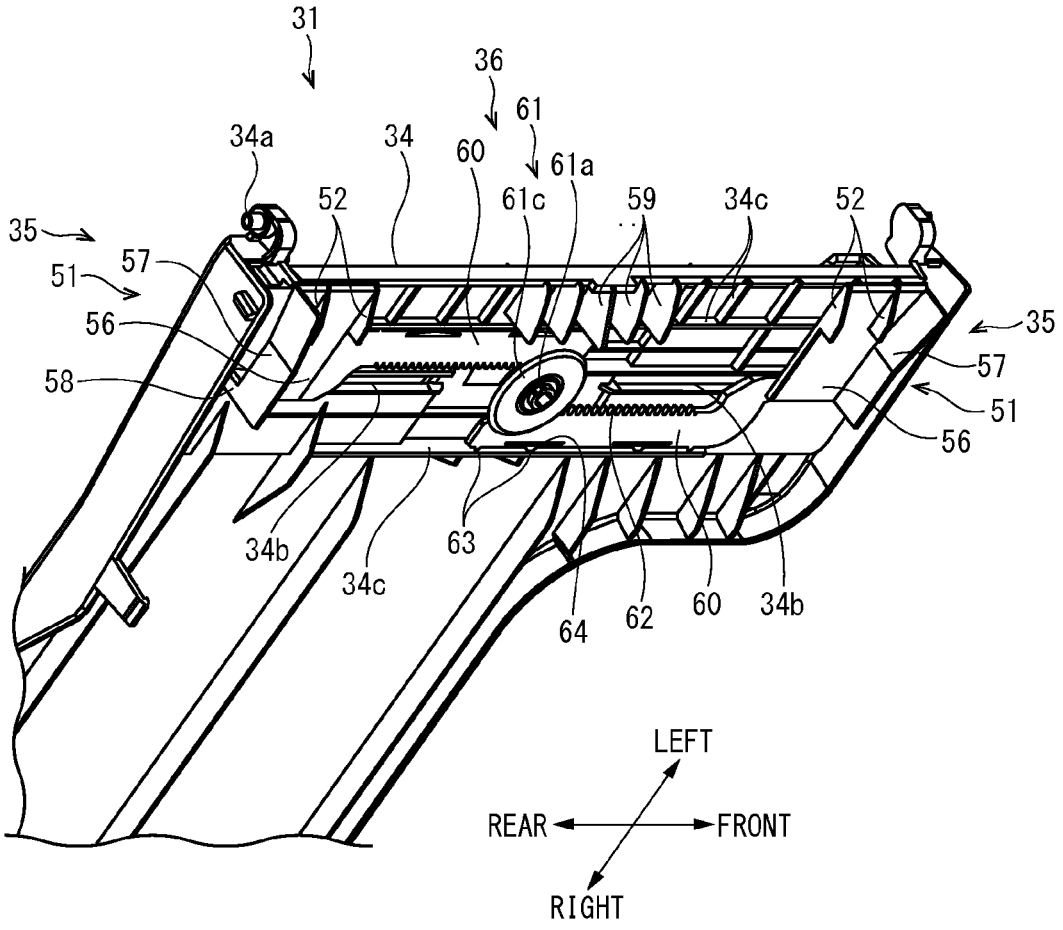
FIG. 5 is a lower perspective view showing a feeding tray according to the embodiment of the present disclosure.
Figure 6:
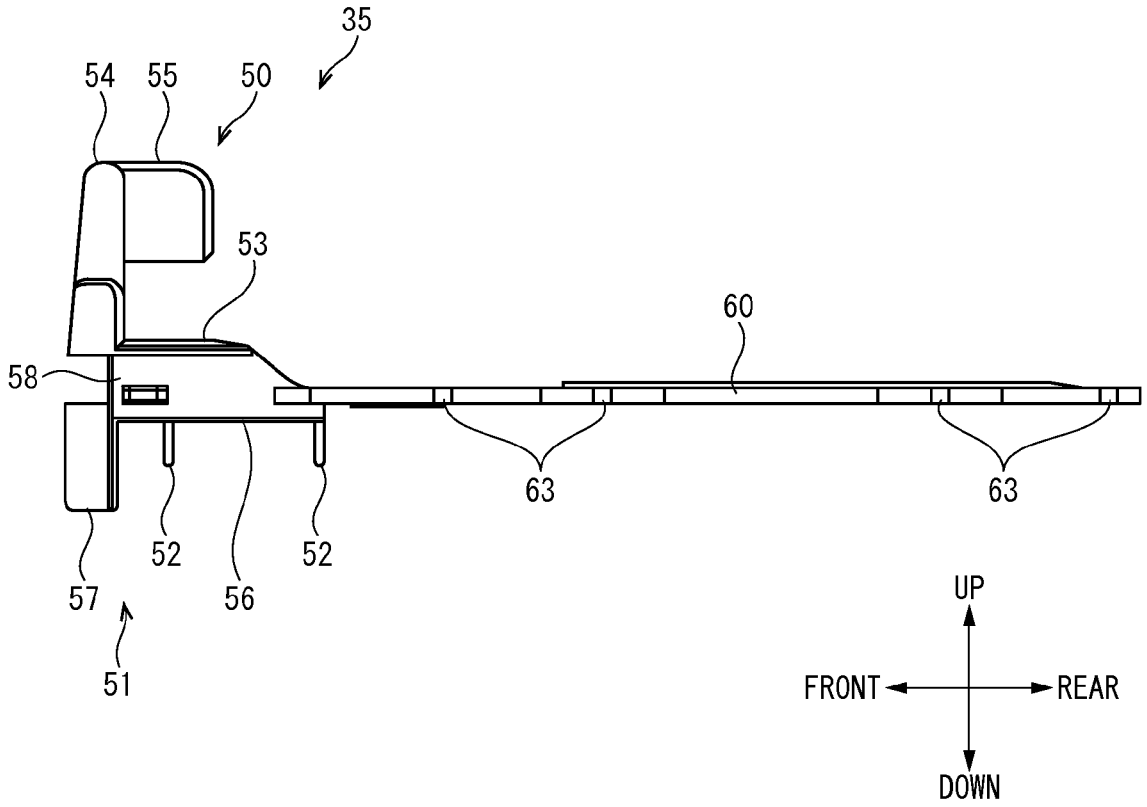
FIG. 6 is a right side view showing a document conveying guide according to the embodiment of the present disclosure.
Figure 7:
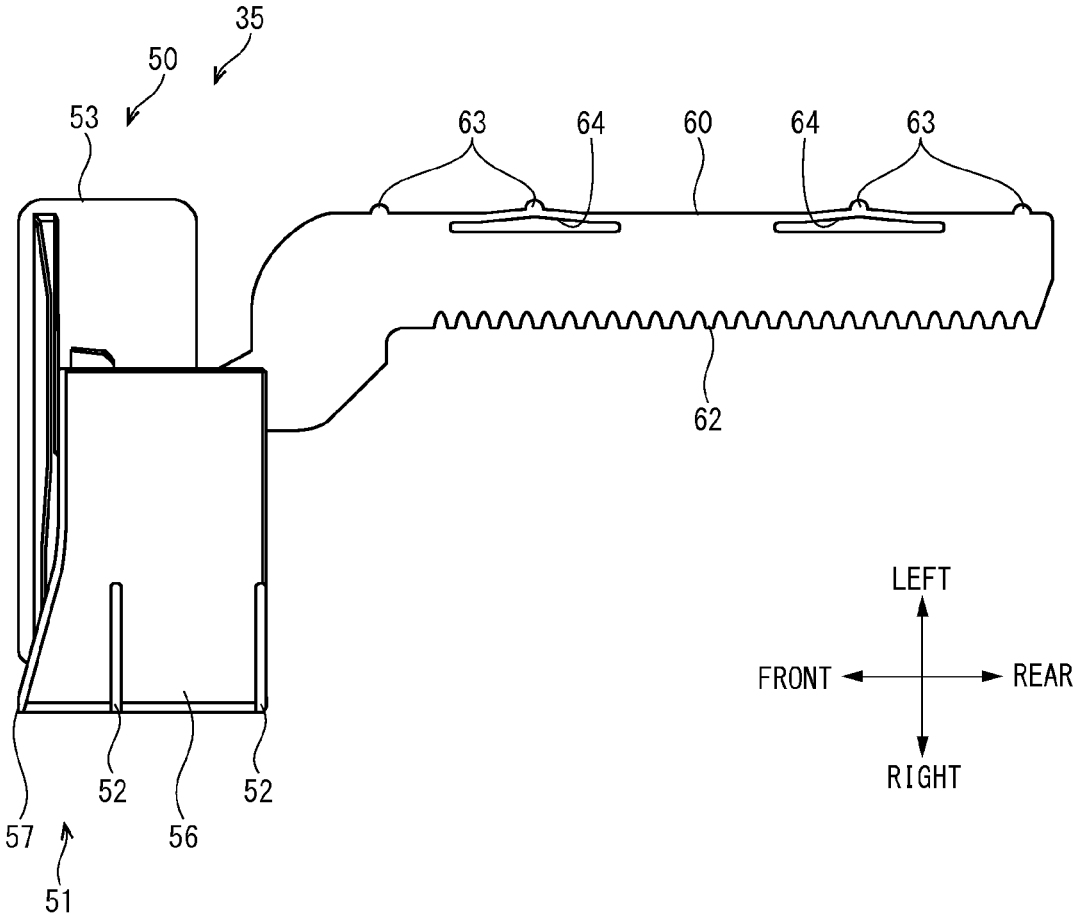
FIG. 7 is a bottom face view showing the document conveying guide according to the embodiment of the present disclosure.
Figure 8:
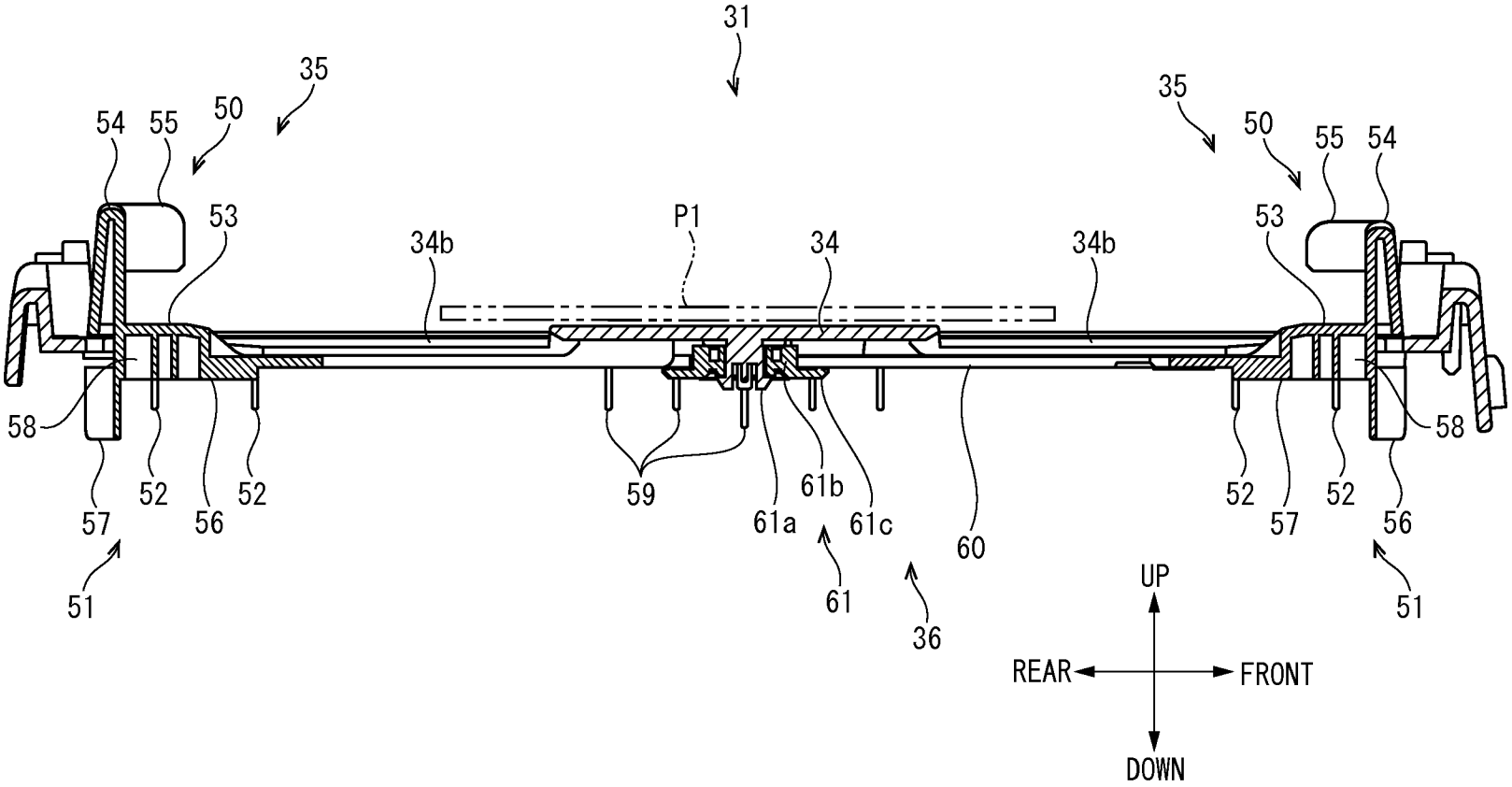
FIG. 8 is a sectional view showing the document conveying guide with a guide width in a widened state according to the embodiment of the present disclosure.
Figure 9:
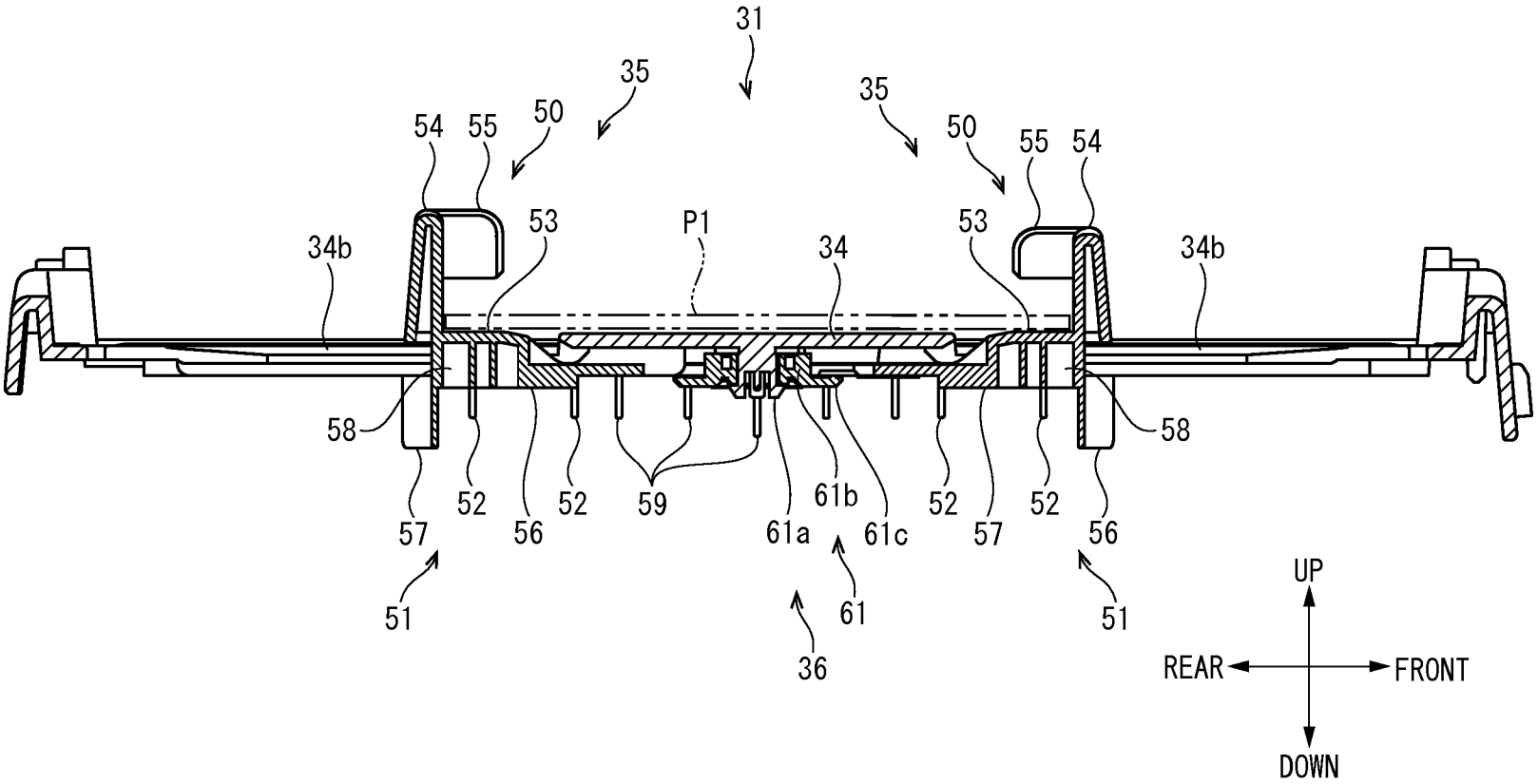
FIG. 9 is a sectional view showing the document conveying guide with the guide width in a narrowed state according to the embodiment of the present disclosure.

Next, with reference to FIGS. 2 to 7, the document feeding device 5 will be described in detail. FIG. 3 is a perspective view of the document feeding device 5. FIG. 4 is a side sectional view of the document feeding device 5. FIG. 5 is a lower perspective view of a feeding tray. FIG. 6 is a right side view of a document conveying guide. FIG. 7 is a bottom face view of the document conveying guide. FIG. 8 is a sectional view of the document conveying guide with a guide width in a widened state. FIG. 9 is a sectional view of the document conveying guide with the guide width in a narrowed state. In the following description, a forward or backward direction of the image forming apparatus 1 is often called as a "width direction" of the document P1, and a left or right direction of the image forming apparatus 1 is often called as a "conveying direction" or an "ejecting direction" of the document P1.

The document feeding device 5 is a so-called automatic document feeder (ADF). The document feeding device 5 is attached turnably around one side at a back face side of an upper part of the scanner part 4. By lifting upward and turning a front face side of the document feeding device 5, upper faces of the contact glass 20 and platen glass 21 are exposed.

As shown in FIGS. 2 to 4, the document feeding device 5 is provided with a roughly box-formed cover flame 30, a feeding tray 31 used for the placement of the document P1, a conveying device 32 feeding the document P1 on the feeding tray 31 to the scanner part 4, and an ejecting tray 33 receiving the document P1 after image reading ejected by conveying device 32.

The cover flame 30 is made by a resin material. A right side face of the cover flame 30 is formed to be inclined upward to a downstream side in the conveying direction. In the right side face of the cover flame 30, a side face opening 30*a* is formed. In a lower face of the cover flame 30, a lower face opening 30*b* facing to the contact glass 20 is formed (refer to FIG. 4).

As shown in FIGS. 3 to 5, the feeding tray 31 has a receiving plate-like document set table 34 extended to the right side of the cover flame 30, a pair of document conveying guides 35 configured to be movable in the width direction (a direction intersecting a feeding direction of the document P1) of the document set table 34, a interlock connecting mechanism 36 making the pair of document conveying guides 35 interlocked with each other and moved. In the embodiment, the document set table 34, document conveying guides 35, interlock connecting mechanism 36 and the others are made by a resin material.

The document set table 34 is arranged to be slightly inclined downward to the cover flame 30. The document set table 34 is formed into a shape of a front right side in a plan view cut out largely backward (refer to FIG. 1). On the document set table 34, a plurality of the documents P1 are placed. Each document P1 is conveyed from the left side to the right side. A left end part of the document set table 34 is inserted in the cover frame from the side face opening 30*a*. A pair of turn supporting axis parts 34*a* (refer to FIG. 5) protruded to both outsides in the width direction of the document set table 34 are pivotally supported by both inner walls of the cover frame 30. Thus, the document set table 34 is configured to turn upward around the turn supporting axis parts 34*a*.

In the document set table 34, a pair of front and rear slits 34*b* extending in the width direction are penetratingly formed. The pair of slits 34*b* are arranged in parallel in the width direction at the downstream side in the conveying direction of the document set table 34 (in the vicinity of the cover frame 30). On a lower face of the document set table 34, a plurality of reinforcement ribs 34*c* ensuring rigidity are protruded so as to extend in forward and backward, and leftward and rightward directions.

In each slit 34*b*, each document conveying guide 35 is slidably provided, and its detail will be described below. The pair of document conveying guides 35 are configured to move interlockingly by the interlock connecting mechanism 36.

As shown in FIG. 4. The conveying device 32 is configured to have a plurality of rollers and others, and the rollers are rotatably provided along a document conveying path 40 arranged inside the cover frame 30. Concretely, the conveying device 32 has a pickup roller 41, a feeding roller 42, a conveying roller 43, a following roller 44 and a pair of ejecting rollers 45. The pickup roller 41 is arranged in the vicinity of the side face opening 30*a*. The feeding roller 42 is arranged at a downstream side from the pickup roller 41. The conveying roller 43 is arranged at obliquely lower side from the feeding roller 42. The following roller 44 is arranged to come into contact with the conveying roller 43 and to rotate by following the conveying roller 43. The ejecting rollers 45 are arranged in the vicinity of an ejecting port 30*c* opened below the side face opening 30*a*.

The document conveying path 40 is arranged to be into a U-shape by turning back and to communicate the side face opening 30*a* and ejecting port 30*c*.

The pickup roller 41 is connected with the feeding roller 42 via a connecting gear 41*a*. The pickup roller 41 is configured to turn upward and downward around a rotating axis of the feeding roller 42. The pickup roller 41 turns from a waiting position at an upper side to a sheet feeding position at a lower side. Thus, the document P1 on the feeding sheet tray 31 is picked up and fed one by one.

Below the feeding roller 42, a nip member 47 biased by a coil spring 46 is provided. The document P1 delivered from the pickup roller 41 passes through between the feeding roller 42 and nip member 47 and is conveyed to a downstream side in the document conveying path 40.

The document P1 fed by the feeding roller 42 passes through between the conveying roller 43 and following roller 44 and is conveyed onto the contact glass 20 arranged below the conveying roller 43.

Above the contact glass 20, a pressuring member 49 is provided and biased by a coil spring 48 so to project downward from the lower face opening 30*b*. The pressuring member 49 applies pressuring force onto the document P1 on the contact glass 20. Therefore, the conveyed document P1 is pressed against the contact glass 20 by the pressuring member 49, and then, conveyed to the downstream side in the document conveying path 40. When the document P1 passes through between the contact glass 20 and pressuring member 49, image information of the document P1 is read by the optical scanning unit 22.

The document P1 after the reading of the image information is ejected on the ejecting tray 33 from the ejecting port 30*c* by rotation of the pair of ejecting roller 45.

The ejecting tray 33 is made by a resin material. The ejecting tray 33 is extended to the right side of the ejecting port 30*c* of the cover frame 30. The ejecting tray 33 is formed into a receiving plate-like shape so as to enable reception of the ejected document P1 below the feeding tray 31. A face receiving the document P1 in the ejecting tray 33 is formed roughly in parallel with the document set table 34 of the feeding tray 31. In the ejecting tray 33, at the downstream side in the conveying direction and at the center in the width direction, a protruded part 33*a* inclined upward to the downstream is provided.

Incidentally, a downstream end section in the document conveying path 40 is arranged to be inclined upward to the ejecting tray 33 (refer to FIG. 4). Therefore, the document P1 is fed obliquely upward from the ejecting port 30*c* onto the ejecting tray 33. Thus, the following ejected document P1 is prevented from colliding with the already ejected document P1 stacked on the ejecting tray 33.

Next, with reference to FIGS. 3 to 9, each document conveying guide 35 and interlock connecting mechanism 36 of the feeding tray 31 will be described in detail.

Each document conveying guide 35 has a feeding guide 50 regulating a position in the width direction of the document P1 placed on the document set table 34, an ejecting guide 51 regulating a position in the width direction of the ejected document P1 and two conveying ribs 52 leading the ejected document P1 on the ejecting tray 33. Since the pair of front and rear document conveying guides 35 are arranged to face to each other in the width direction of the document P1 and have roughly similar (bilateral symmetry) configuration, the front document conveying guide 35 will be mainly described hereinafter.

As shown in FIGS. 6 and 7, the feeding guide 50 has a feeding side supporting plate 53 arranged in parallel with an upper face of the document set table 34 and a feeding side cursor 54 arranged to extend upward from the front end of the feeding side supporting plate 53.

The side supporting plate 53 is formed into a roughly rectangular plate shape in a planar view. The feeding side cursor 54 is formed into a trapezoid plate shape in a side view (refer to FIGS. 3 and 4). At a downstream side upper end of the feeding side cursor 54, a document holding part 55 is provided to extend to the inside in the width direction.

An upstream side (a right side) of the document holding part 55 is formed to be inclined downward to the downstream. A downstream side (a left side) of the document holding part 55 is formed roughly in parallel with the feeding side supporting plate 53 (refer to FIGS. 3 and 4). That is, the document holding part 55 is formed in a body by bending so as to have a downward convex in a side view.

As shown in FIGS. 5 to 7, the ejecting guide 51 has an ejecting side supporting plate 56 arranged in parallel with the lower face of the document set table 34 and an ejecting side cursor 57 arranged to extend downward from a front end of the ejecting side supporting plate 56.

The ejecting side supporting plate 56 is formed into a roughly rectangular plate shape in a planar view. The ejecting side cursor 57 is formed into a roughly rectangular plate shape in a side view. The ejecting side cursor 57 is formed by bending the ejecting port 30C's side (an upstream side in the conveying direction) to the outside in the width direction. That is, the pair of ejecting guide 51 are configured so that a guide width at the ejecting port 30C's side is wider than another guide width at the downstream side in the conveying direction.

As shown in FIGS. 5, 6, 8 and 9, the feeding guide 50 and ejecting guide 51 are integrally connected to each other by a connecting part 58. In detail, an upper part of the connecting part 58 is connected to a right side (the upstream side in the conveying direction) of the feeding side supporting plate 53. A lower part of the connecting part 58 is connected to a right end part (the downstream end in the ejecting direction) of the ejecting side supporting plate 56. Thus, the feeding guide 50 and ejecting guide 51 are integrally configured to be in parallel across the document set table 34.

The connecting part 58 slidably engages with the above-mentioned slit 34*b*. In detail, when a lower face of the feeding side supporting plate 53 comes into slidably contact with the upper face of the document set table 34 and an upper face of the ejecting side supporting plate 56 comes into slidably contact with the lower face of the document set table 34, the connecting part 58 engages with the slit 34*b*. Thus, the feeding guide 50 and ejecting guide 51 integrated via the connecting part 58 are configured to interlock with each other, and then, to be guided by the slit 34*b* and to move in the width direction.

As shown in FIGS. 5 to 9, two conveying ribs 52 are protruded downward from the lower face of the ejecting side supporting plate 56. In detail, two conveying ribs 52 are positioned at a rear end part and an ejecting side cursor 57's side in the ejecting side supporting plate 56. Each conveying rib 52 is extended from an end part at the ejecting port 30*c*'s side to the downstream side along the ejecting direction. Moreover, each conveying rib 52 is inclined downward to the downstream in the ejecting direction. Each conveying rib 52 is formed into a trapezoid shape in a side view.

As shown in FIGS. 5, 8 and 9, in a center range in the width direction on the lower face of the document set table 34, five fixed ribs 59 are protruded and arranged at equal interval in the width direction. Each fixed rib 59 is arranged in parallel with each conveying rib 52 in the width direction. Except for one fixed rib 59 at the center in the width direction, other fixed ribs 59 are formed into the roughly similar shape to the conveying rib 52. The center fixed rib 59 is formed slightly larger than the other fixed ribs 59 into a roughly triangle shape in a side view. All the fixed ribs 59 are positioned so as to come into slidably contact with the document P1 having minimum width. That is, the fixed ribs 59 are arranged inside minimum width one of the documents P1 to be conveyed.

Next, as shown in FIGS. 4 to 9, the interlock connecting mechanism 36 is configured integrally with the ejecting side supporting plate 56. The interlock connecting mechanism 36 has a pair of front and rear rack parts 60 extending to the inside in the width direction and a pinion gear 61 meshing with the pair of rack parts 60.

As shown in FIG. 5, the front rack part 60 is extended backward from an inside corner at the downstream side (the right side) in the ejecting direction in the ejecting side supporting plate 56. The rear rack part 60 is extended forward from the roughly center in the ejecting direction in the ejecting side supporting plate 56.

The rack parts 60 are arranged to leave a predetermined space in the ejecting direction not to contact with each other. The rack parts 60 are arranged in parallel with and at the same level as the lower face of the document set table 34. In facing end faces of the rack parts 60, teeth parts 62 are respectively formed. In another end face opposite to each teeth part 62, four protruded parts 63 are formed in parallel (refer to FIGS. 6 and 7). The protruded parts 63 are configured to come into slidably contact with the reinforcement rib 34*c* extending in the width direction.

In each rack part 60, in the vicinity of two protruded parts 63 at the center side in the width direction, spring openings 64 are penetratingly formed (refer to FIGS. 6 and 7). The protruded part 63 corresponding to the spring opening 64 is configured to elastically move in the ejecting direction.

As shown in FIGS. 4, 5, 8 and 9, the pinion gear is turnably supported by a gear axis 61*a* protruded downward from the lower face of the document set table 34 at the downstream side (the right side) from the fixed rib 59 in the ejecting direction and at the center in the width direction. The pinion gear 61 is composed of a gear main body 61*b* having a peripheral face in which a plurality of tooth part (not shown) are formed, and a flange part 61*c* integrally formed in a lower face of the gear main body 61*b*.

The gear main body 61*b* is meshed with the rear rack part 60 at the upstream side in the ejecting direction. The gear main body 61*b* is meshed with the front rack part 60 at the downstream side in the ejecting direction. That is, the gear main body 61*b* is arranged to be put between the pair of the rack parts 60.

The flange part 61*c* is formed to have a larger diameter than the gear main body 61*b*. The flange part 61*c* is arranged coaxial with the gear main body 61*b*. A lower face at the teeth part 62's side in each rack part 60 is arranged to come into slidably contact with an upper face of the flange part 61*c*.

Next, as shown in FIGS. 8 and 9, an action of the document feeding device 5 configured as mentioned above will be described. As one example, a case where the pair of the document conveying guides 35 are shifted from a state of having a widened guide width (refer to FIG. 8) to another state of having a narrowed guide width (refer to FIG. 9), i.e. a case of reducing the guide width of the document conveying guides 35, will be described.

A user places the document P1 (or a sheaf of the documents P1), the reading of which is desired by the user, on the document set table 34 (refer to two-dot chain line in FIG. 8). At this time, since the document holding part 55 of each feeding guide 50 is heightened to the upstream side, the user can easily place the document P1 from the upstream side to the downstream side in the conveying direction. In addition, at the downstream side of the document holding part 55, since a height from the document set table 34 becomes a predetermined level, the number of the document P1 that can be set is regulated. Thus, it is possible to prevent document conveyance error caused in a case where the documents (the sheaf) are set beyond the settable number.

Next, the user grasps any one of the pair of the front and rear feeding guides 50 and moves it in the width direction so that the feeding side cursors 54 come into contact with both ends in the width direction of the document P1 (refer to FIG. 9).

At this time, since the one rack part 60 integrally configured with the one feeding guide 50 is also moved, the pinion gear 61 meshed with the one rack part 60 is rotated in a moving direction of the rack part 60. Since the rotation of the pinion gear 61 is transmitted to the other rack part 60, the other feeding guide 50 is moved in synchronization with and at equal distance to the movement of the one feeding guide 50. The pair of the front and rear feeding guides 50 equally are moved from the center in the width direction of the document P1 to a direction of reducing the guide width. That is, the interlock connecting mechanism 36 moves the pair of the front and rear feeding guides 50 symmetrically from the center in the width direction of the document P1. Thus, the document P1 is gathered to the center in the width direction and the both ends are guided by the feeding side cursors 54.

Since the feeding guide 50 is integrally configured with the ejecting guide 51 and conveying rib 52 via the connecting part 58, the pair of the front and rear ejecting guides 51 and a plurality of the conveying ribs 52 are also moved in a direction of reducing the guide width symmetrically from the center in the width direction of the document P1. Thus, the respective guide widths between the pair of the feeding guides 50 and between the pair of the ejecting guides 51 are interlockingly adjusted at the same time. Simultaneously, each conveying rib 52 is adjusted to a position corresponding to the size of the document P1.

Incidentally, because the connecting part 58 is guided by the slit 34*b* to slide in the width direction, a length of the slit 34*b* is a movable range of the document conveying guide 35. Each protruded part 63 of each rack part 60 comes into slidably contact with the reinforcement rib 34*c* and the lower face at the teeth part 62's side of each rack part 60 comes into slidably contact with the upper face of the flange part 61*c*. Further, the protruded part 63 near which the spring opening 64 is formed comes into slidably contact with the reinforcement rib 34*c* extending in the width direction, thereby applying suitable load to movement of the rack part 60. Thus, an adjusted position of the document conveying guide 35 is appropriately maintained.

Next, the document P1 set on the document set table 34 is fed one by one to the document conveying path 40 by the conveying device 32, image information of the document P1 is read by the optical scanning unit 22 and CCD 25, and then, the document P1 is ejected from the ejecting port 30*c*.

As mentioned above, since the document conveying path 40 is inclined upward to the downstream in the ejecting direction, the document P1 is ejected obliquely upward from the ejecting port 30*c* onto the ejecting tray 33. The ejected document P1 is guided by the pair of the front and rear ejecting guides 51, and simultaneously, comes into contact with each conveying rib 52 and each fixed rib 59. Thus, the ejecting direction of the document P1 is changed to an obliquely downward side. The document P1 ejected while slidably contacting with each conveying rib 52 and each fixed rib 59 is placed at an appropriate position on the ejecting tray 33.

Incidentally, as mentioned above, since the pair of the conveying guides 51 are configured so that the guide width becomes wide at the ejecting port 30*c*'s side, for example, even if the document P1 is ejected unevenly in the width direction, it is possible to appropriately guide the document P1 to the pair of the ejecting guides 51. Thus, it is possible to prevent the document conveyance error.

Incidentally, an action in case of increasing the guide width of the pair of the document conveying guides 35 is achieved in the similar way to the above-mentioned action. In addition, the user may operate both the document conveying guides 35 by both hands.

In accordance with the image forming apparatus 1 according to the above-mentioned embodiment, when each feeding guide 50 (the feeding side cursor 54) is moved according to the width of the document P1 placed on the feeding tray 31, the conveying ribs 52 are simultaneously moved. That is, each conveying rib 52 is adjusted to a position corresponding to the size of the document P1 set on the feeding tray 31, in synchronization with the movement of the feeding guide 50. Thus, if the document is feedable one, it is possible to face each conveying rib 52 to an appropriate position regardless of the size of the document. Therefore, it is possible to prevent the number of the conveying ribs 52 from increasing as kinds of the document sizes to be handled are increased. In addition, since each conveying rib 52 is always adjusted to the appropriate position for the size of the document P1, it is possible to prevent an occurrence of ejection interference of the document caused in a case where a lot of conveying ribs are provided for each size.

Moreover, in accordance with the image forming apparatus 1 according to the embodiment, by setting the guide width of the pair of the feeding guides 50, the guide width of the pair of the ejecting guides are simultaneously set. The ejected document P1 is placed on the ejecting tray 33 in a state where the edges of the document P1 are arranged in the width direction. Thus, it is possible to orderly stack the ejected document P1 by simple operation. In addition, the ejecting guide 51 and each conveying rib 52 are integrally moved. Thus, it is possible to securely prevent a problem caused if the conveying rib 52 were fixedly provided, for example, a problem that the moving ejecting guide 51 interferes with the fixed conveying rib 52.

Further, in accordance with the image forming apparatus 1 according to the embodiment, when one (or other) feeding guide 50 is moved, other (or one) feeding guide 50 is synchronously moved via the interlock connecting mechanism 36. Thus, it is possible to carry out position adjustment of each feeding guide 50, each ejecting guide 51 and each conveying rib 52 (each document conveying guide 35) by once operation. Therefore, it is possible to improve operability for the adjustment. In addition, since the document conveying guides 35 are evenly and symmetrically moved with the center in the width direction of the document P1 as a standard, it is possible to carry out the above-mentioned adjustment by a small movement amount.

Incidentally, the interlock connecting mechanism 36 may be omitted and the pair of the front and rear document conveying guides 35 may be configured so as to be movable separately. In such a case, it is possible to adjust the guide width while the document P1 set at an optional position in the width direction on the document set table 34 (the feeding tray) is put between the document conveying guides 35. Simultaneously, it is possible to adjust a position of the conveying rib.

Incidentally, the interlock connecting mechanism 36 may be omitted, and then, any one of the document conveying guides 35 may be fixed and other document conveying guide 35 may be slidably configured.

Incidentally, the ejecting side cursor 57 of each ejecting guide 51 may be omitted.

In the embodiment, the guide width of the pair of the feeding side cursors 54 is equal to the guide width at the downstream side in the ejecting direction of the pair of the ejecting side cursors 57. That is, each feeding side cursor 54 and each ejecting side cursor 57 are arranged at the same position in the width direction. However, each ejecting side cursor 57 may be arranged outside of each feeding side cursor 54 in the forward and backward directions. Thus, the ejected document P1 is appropriately led between the pair of the ejecting side cursors 57 (inside the guide width). In such a case, because the document P1 is slightly moved in the width direction (the forward and backward directions), each conveying rib 52 is preferably arranged at a position where end parts in the width direction of the document P1 are not caught.

While the preferable embodiment and its modified example of the image forming apparatus 1 of the present disclosure have been described above and various technically preferable configurations have been illustrated, a technical range of the disclosure is not to be restricted by the description and illustration of the embodiment. Further, the components in the embodiment of the disclosure may be suitably replaced with other components, or variously combined with the other components. The claims are not restricted by the description of the embodiment of the disclosure as mentioned above.

What is claimed is:

1. A sheet feeding device, comprising:

a feeding tray on which a sheet is placed;

a conveying device feeding the sheet on the feeding tray to an image reading device;

an ejecting tray receiving the sheet after image reading;

a feeding guide configured to be movable in a direction intersecting a feeding direction of the sheet and to regulate a position in a width direction of the sheet on the feeding tray;

a conveying rib configured to be movable in interlocking with movement of the feeding guide and to lead the sheet to be ejected onto the ejecting tray;

an ejecting guide configured to be movable together with the conveying rib in interlocking with movement of the feeding guide and to regulate a position in the width direction of the ejected sheet; and fixed ribs arranged in parallel with the conveying rib in the width direction of the sheet and positioned so as to come into slidably contact with the sheet having minimum width;

wherein a pair of the feeding guides, a pair of the conveying ribs and a pair of the ejecting guides are arranged so as to respectively face to each other in the width direction of the sheet, so that the guide width of the pair of the ejecting guides may be wider than the guide width of the pair of the feeding guides; and one fixed rib at the center in the width direction is formed larger than the other fixed ribs.

2. The sheet feeding device according to claim 1, further comprising:

an interlock connecting mechanism arranged between one feeding guide and one conveying rib and other feeding guide and other conveying rib and configured to make the pair of feeding guides and the pair of conveying ribs respectively interlocked with each other and evenly moved from the center in the width direction of the sheet;

wherein the interlock connecting mechanism has a pair of rack parts configured integrally with the ejecting guide to extend to the inside in the width direction and a pinion gear meshing with the pair of rack parts, and protruded parts are formed in another end face opposite to each teeth part of the rack parts, said protrude parts are configured to slidably contact with a member extending in the width direction.

3. The sheet feeding device according to claim 1, wherein the pair of the ejecting guides are configured so that a guide width at an ejecting port side of the ejected sheet is wider than another guide width at a downstream side in an ejecting direction.

4. An image forming apparatus comprising:

a sheet feeding device including:

a feeding tray on which a sheet is placed;

a conveying device feeding the sheet on the feeding tray to an image reading device;

an ejecting tray receiving the sheet after image reading;

a feeding guide configured to be movable in a direction intersecting a feeding direction of the sheet and to regulate a position in a width direction of the sheet on the feeding tray;

a conveying rib configured to be movable in interlocking with movement of the feeding guide and to lead the sheet to be ejected onto the ejecting tray;

an ejecting guide configured to be movable together with the conveying rib in interlocking with movement of the feeding guide and to regulate a position in the width direction of the ejected sheet; and fixed ribs arranged in parallel with the conveying rib in the width direction of the sheet and positioned so as to come into slidably contact with the sheet having minimum width;

wherein a pair of the feeding guides, a pair of the conveying ribs and a pair of the ejecting guides are arranged so as to respectively face to each other in the width direction of the sheet, so that the guide width of the pair of the ejecting guides may be wider than the guide width of the pair of the feeding guides; and one fixed rib at the center in the width direction is formed larger than the other fixed ribs.

5. The image forming apparatus according to claim 4, the sheet feeding device further includes:

an interlock connecting mechanism arranged between one feeding guide and one conveying rib and other feeding guide and other conveying rib and configured to make the pair of feeding guides and the pair of conveying ribs respectively interlocked with each other and evenly moved from the center in the width direction of the sheet;

wherein the interlock connecting mechanism has a pair of rack parts configured integrally with the ejecting guide to extend to the inside in the width direction and a pinion gear meshing with the pair of rack parts, and protruded parts are formed in another end face opposite to each teeth part of the rack parts, said protrude parts are configured to slidably contact with a member extending in the width direction.

6. The image forming apparatus according to claim 4, wherein the pair of the ejecting guides are configured so that a guide width at an ejecting port side of the ejected sheet is wider than another guide width at a downstream side in an ejecting direction.

* * * * *